US009261810B2

(12) United States Patent
Zona

(10) Patent No.: US 9,261,810 B2
(45) Date of Patent: Feb. 16, 2016

(54) MARKING MATERIAL DELIVERY APPARATUS HAVING MULTIPLE CHARGE BLADES

(71) Applicant: XEROX CORPORATION, Norwalk, CT (US)

(72) Inventor: Michael F. Zona, Holley, NY (US)

(73) Assignee: Xerox Corporation, Norwalk, CT (US)

( * ) Notice: Subject to any disclaimer, the term of this patent is extended or adjusted under 35 U.S.C. 154(b) by 81 days.

(21) Appl. No.: 13/963,018

(22) Filed: Aug. 9, 2013

(65) Prior Publication Data

US 2015/0043949 A1 Feb. 12, 2015

(51) Int. Cl.
*G03G 15/08* (2006.01)
*G03G 15/06* (2006.01)

(52) U.S. Cl.
CPC ..... *G03G 15/0808* (2013.01); *G03G 15/065* (2013.01)

(58) Field of Classification Search
USPC ..... 399/284
See application file for complete search history.

(56) References Cited

U.S. PATENT DOCUMENTS

| | | | | |
|---|---|---|---|---|
| 4,194,830 | A * | 3/1980 | Ohnuma et al. | 399/284 |
| 4,458,627 | A * | 7/1984 | Hosono et al. | 399/274 |
| 4,748,472 | A * | 5/1988 | Mukai et al. | 399/283 |
| 5,085,171 | A | 2/1992 | Aulick et al. | |
| 5,245,392 | A | 9/1993 | Behe et al. | |
| 5,339,142 | A | 8/1994 | Hays | |
| 5,504,566 | A | 4/1996 | Chow et al. | |
| 5,649,197 | A * | 7/1997 | Fujita | 399/260 |
| 5,839,041 | A | 11/1998 | Condello et al. | |
| 5,890,033 | A | 3/1999 | Parker | |
| 5,960,239 | A * | 9/1999 | Toyoshima et al. | 399/284 |
| 6,321,058 | B1 * | 11/2001 | Miyasaka et al. | 399/281 |
| 7,242,894 | B2 | 7/2007 | Kuo et al. | |
| 7,567,764 | B2 * | 7/2009 | Yamanaka et al. | 399/53 |
| 7,865,118 | B2 * | 1/2011 | Nakagawa et al. | 399/281 |
| 8,304,066 | B2 | 11/2012 | Anderson et al. | |
| 2013/0034375 | A1 | 2/2013 | Kashiwakura et al. | |
| 2013/0071781 | A1 | 3/2013 | Saito et al. | |
| 2013/0108330 | A1 * | 5/2013 | Kitagawa | 399/284 |

FOREIGN PATENT DOCUMENTS

JP 53116159 A * 10/1978

* cited by examiner

*Primary Examiner* — Quana M Grainger
(74) *Attorney, Agent, or Firm* — Gibb & Riley, LLC

(57) ABSTRACT

A printing apparatus herein includes a sheet feeder and a photoreceptor adjacent the sheet feeder. The photoreceptor receives print media from the sheet feeder, and the photoreceptor transfers toner to the print media. A development roll is adjacent the photoreceptor. The development roll supplies a metered amount of charged toner to the photoreceptor. Also, a supply roll is adjacent the development roll. The supply roll supplies toner to the development roll. In this device, multiple charge blades (e.g., first, second, third, etc., charge blades) contact the development roll, and a charge generator can be electrically connected to the charge blade, supply roll, and development roll.

15 Claims, 3 Drawing Sheets

MARKING MATERIAL DELIVERY APPARATUS HAVING MULTIPLE CHARGE BLADES

BACKGROUND

Systems and methods herein generally relate to printing devices, and more particularly to charge blades within electrostatic printing devices.

Electrostatic printing devices deliver a controlled amount of charged marking material (e.g., toner) to a photoreceptor (or other element capable of maintaining a latent image charge) using what is sometimes referred to as a development roll. The marking material is transferred from the development roll to the photoreceptor, and then from the photoreceptor to a sheet of media to perform printing on the sheet.

The marking material is usually in the form of a powder, such as toner particles. In order to control (or "meter") the amount of marking material that exists on the development roll, a blade is used to scrape excess amounts of marking material off the development roll. In addition, the blade can provide a charge to the marking material particles and, therefore, the blade is sometimes referred to as a "charge blade."

SUMMARY

An exemplary printing apparatus herein includes a sheet feeder and a photoreceptor adjacent the sheet feeder. The photoreceptor receives print media from the sheet feeder, and the photoreceptor transfers toner to the print media. A development roll is adjacent the photoreceptor. The development roll supplies a metered amount of charged toner to the photoreceptor. Also, a supply roll is adjacent the development roll. The supply roll supplies toner to the development roll. In this device, multiple charge blades (e.g., first, second, third, etc., charge blades) contact the development roll, and a charge generator can be electrically connected to the charge blade, supply roll, and development roll.

The development roll has an outer surface moving in a first direction. The first charge blade is positioned before the second charge blade in the first direction. Therefore, the moving outer surface of the development roll contacts the first charge blade before contacting the second charge blade (when moving in the first direction). The contact areas of all such charge blades are positioned in an arc, such that all of the contact areas of the charge blades simultaneously touch the curved outer surface of the development roll.

The first charge blade produces a first amount of charge in the toner on the development roll, and the second charge blade increases the charge within the toner on the development roll (e.g., to a second amount of charge that is larger than the first amount of charge). Also, the first charge blade applies the most pressure (force) of all the charge blades to control the amount of toner positioned on the development roll and the additional charge blades do not affect the amount of toner metered by the first, higher force charge blade.

Stated in more generic terms, various print devices herein include a media feeder (one example of which is a sheet feeder); and a transfer device (one example of which is a photoreceptor) adjacent the media feeder. The transfer device receives print media from the media feeder, and the transfer device transfers marking material (one example of which is a toner) to the print media. A marking material feeder (one example of which is a development roll) is adjacent the transfer device. The marking material feeder supplies the marking material to the transfer device. Further, a supply device (one example of which is a supply roll) is adjacent the marking material feeder. The supply device supplies the marking material to the marking material feeder.

Multiple charge blades contact the marking material feeder, and a charge generator can be electrically connected to the charge blade, supply roll, and marking material feeder. The marking material feeder has an outer surface moving in a first direction. The first charge blade is positioned before the second charge blade in the first direction. Therefore, the moving outer surface of the marking material feeder contacts the first charge blade before contacting the second charge blade (when moving in the first direction). The contact areas of all such charge blades are positioned in an arc, such that all of the contact areas of the charge blades simultaneously touch the curved outer surface of the marking material feeder.

The first charge blade produces a first amount of charge in the toner on the marking material feeder, and the second charge blade increases the charge within the toner on the marking material feeder (e.g., to a second amount of charge that is larger than the first amount of charge). Also, the first charge blade applies the most pressure of all the charge blades to control the amount of toner positioned on the marking material feeder, and the additional charge blades do not affect the amount of toner metered by the first, higher force charge blade. These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

As mentioned above, a charge blade is used to remove excess amounts of marking material from the development roll and provide a charge to the marking material particles, thereby "metering charged particles" on the development roll. The devices described herein include multiple charge blades (applying different force levels against the development roll) to provide precise metering and charge control of marking material particles on a development roll.

The physical structures described herein allow many different types of marking materials to be used in printing devices that require highly controlled charge and metering levels (and would otherwise require specialized marking materials). Therefore, in one example, the physical structures described herein allow a wider variety of marking materials to be used in devices that require a specific type of marking material, allowing less-polluting, lower-cost marking materials to be used in place of more expensive, more rare marking materials. This promotes more recycling of printing cartridges by a wider range of manufacturers, increasing competition, reducing consumer prices, and helping the environment.

Figure 1:
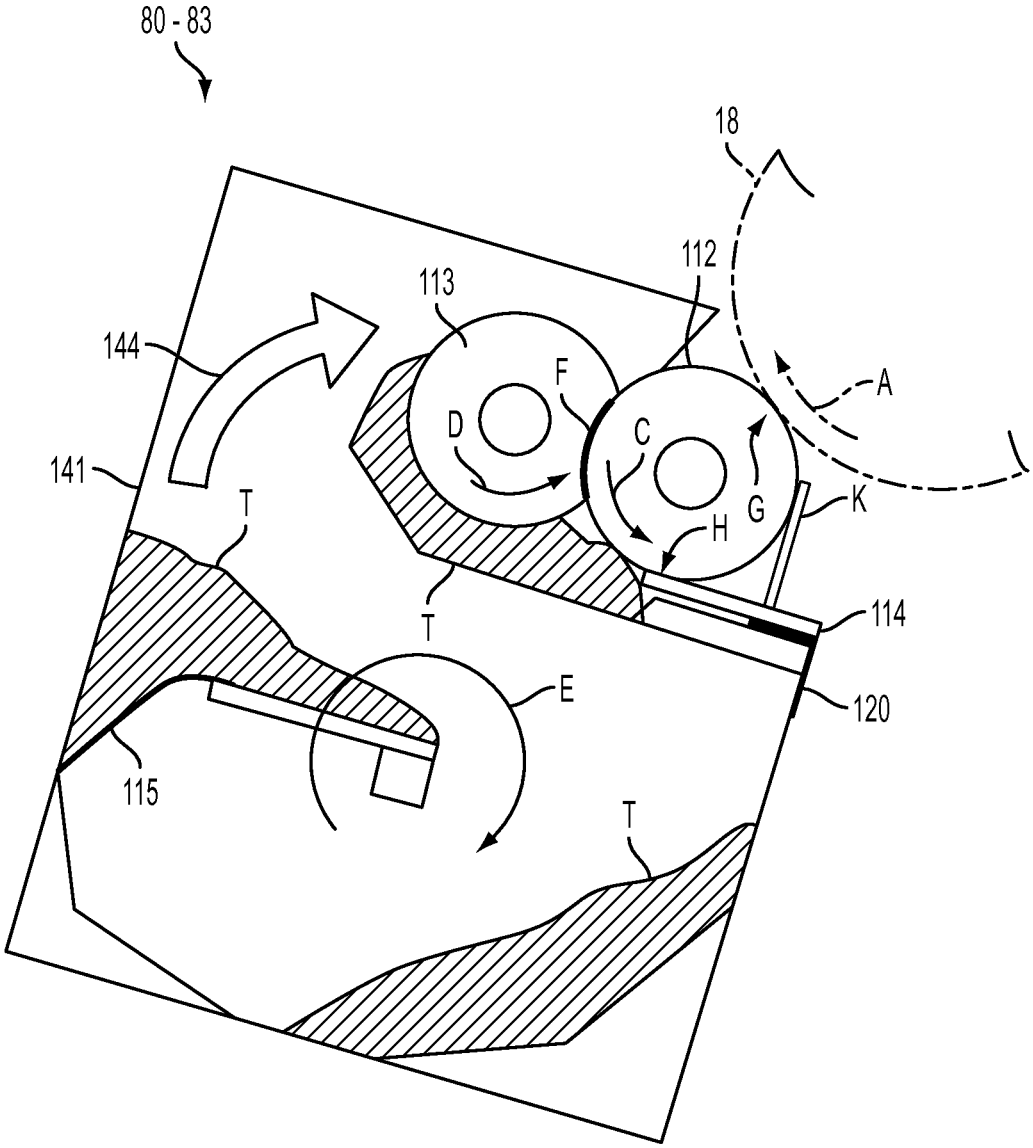
FIG. 1 is a cross-sectional schematic diagram illustrating devices herein.

FIG. 1 illustrates a cross-section of a non-magnetic development system 80-83. In some examples herein, a printing device can include a single development system, and others (such as the one illustrated in FIG. 4, discussed below) can include multiple development systems 80-83. Therefore, FIG. 1 is intended to illustrate a stand-alone development device and/or a development device used in combination with other development devices.

As shown in FIG. 1, toner (T) is maintained in the cartridge sump 141. A paddle 115 that rotates as shown by arrow E, is used to load a supply roller 113 with toner T by moving toner particles to the supply roll area in a direction shown by arrow 144. As shown by arrow D, the supply roller 113 rotates to transfer the toner T to a development roll 112 in a nip F created between the two rolls. In some embodiments, the orientation of the development system 80-83 may be upside down relative to that shown in FIG. 1, so that gravity is used to move toner particles to the supply roll area, instead of a paddle 115.

A charge generator 120 can transfer charge to a charge blade assembly 114 and the charge blade assembly 114 can apply a force against the development roll 112 to generate friction between the toner T and the development roll 112, which electrically charges the toner. The charge blade scrapes off excess toner T from the development roll 112 to meter (control) the amount of toner T that remains on the development roll 112 as the surface of the development roll 112 moves toward a photoreceptor 18. Thus, as the development roll 112 rotates as shown by arrow C, the toner T is charged and metered in the nips H and K of the charge blade assembly 114 that is held in contact against the development roll 112 with a pre-determined force. After the surface of the development roll 112 moves past the charge blade assembly 114, enough charged toner T is brought into the development zone G (at the nip G where the development roll contacts the photoreceptor 18) to support acceptable solid area and half-tone uniformity on the latent image on the photoreceptor 18.

The charge blade assembly 114 can be made of any electrically conductive material, such as a thin piece of metal (e.g., steel, bronze, copper, etc.), plastic, polymer, alloy, etc., that is mounted on a rigid holder connected to the development housing. The physical properties and the dimensions of the charge blade assembly 114 (i.e., modulus, thickness, free length, etc.) are selected to provide an optimal normal force against the development roll 112 that will provide good charging and metering of the toner that enters into the nips H and K.

Figure 2:
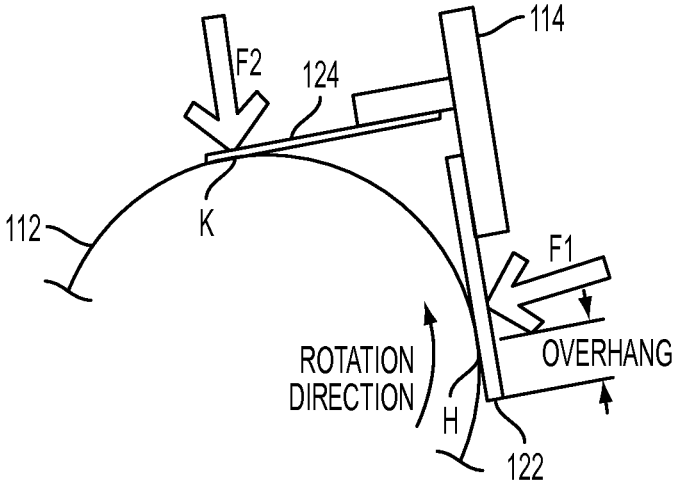
FIG. 2 is a cross-sectional schematic diagram illustrating devices herein.

FIG. 2 is a cross-sectional view of the elements included in FIG. 1 (shown from a different angle) focused in the area around nips H and K. As shown in FIG. 2, the charge blade assembly 114 has two charge blades 122 and 124. Toner T should be able to charge and flow in this nips H and K to enable sufficiently charged developed mass on the photoreceptor 18 when brought into contact with the latent image.

As shown in FIG. 2, the charge blade design has multiple charge blades 122, 124, which enable more contact area in nips H and K between the charge blade assembly 114 and outer surface of the development roll 112, and which increases the tribo charge of the toner and provides precise metering of the amount of toner on the development roll 112. As shown by the force arrow in the drawings, the blade forces F1 and F2 applied by the charge blades 122, 124 are perpendicular to the developer roll 112 circumference.

Further, in addition, the first blade 122 has a force (F1) that causes the toner to rub against the development roll surface and tribo-electrically charge. The second blade 124 provides a relatively smaller force (F2) that is lower than the larger force of the first blade (F1). The force F2 is lower than force F1 so that the second charge blade 124 does not further meter the toner layer that was created by the first blade 122. In this way, all the toner that goes through contact nip H, also goes through contact nip K, but the charge increases in each nip. Thus, the second blade 124 provides added frictional area to improve the charging of the toner beyond the charge that the first blade 122 provides, without modifying the thickness of the toner layer presented to the development zone.

The area of the nips and overhang impacts how well the toner charges, both average charge and charge distribution. The multiple charge blade structures can be formed by extrusion, using molds, can be formed using die presses, can be formed using milling, etc., and can be a single, monolithic piece or can be a separate component mounted to a thin blade which forces the multiple charge blades against the developer roll surface.

When some non-standard toners (e.g., toners other than those called for by the printer manufacturer) are used, they may not be able to charge fast enough with conventional flat charge blades that have a relatively smaller nip than the nips H and K shown in the accompanying drawings. This can lead to low density and higher background than the original toner call for by the manufacturer.

Figure 3:
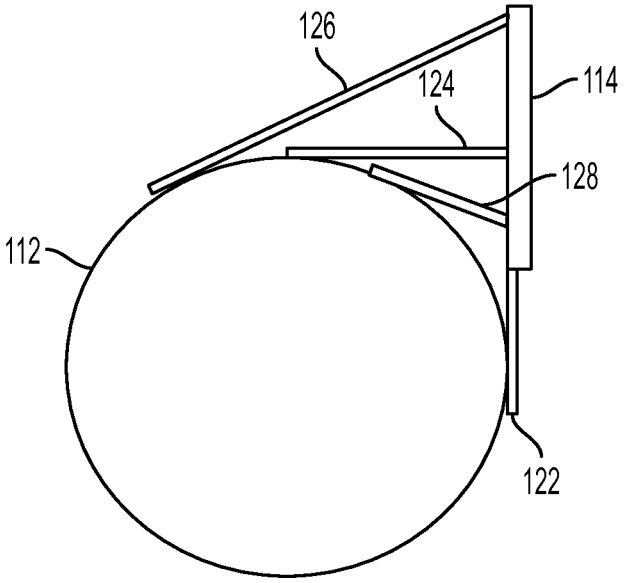
FIG. 3 is a cross-sectional schematic diagram illustrating devices herein.

FIG. 3 illustrates that additional charge blades 126, 128 can be included in addition to the second charge blade 124. The force or pressure exerted by these additional blades 124, 126, 128 are all less than the force exerted by the first charge blade 122 so that the additional blades 124, 126, 128 do not remove any toner that has been allowed to remain on the development roll 112 by the first charge blade. In some structures the force exerted by the additional blades 124, 126, 128 can be progressively less in each blade in the rotational direction of the development roll 112.

In addition, the contact areas formed between the development roll 112 and the additional blades 124, 126, 128 are all less than the contact area formed between the development roll 112 and the first charge blade 122 (or can be progressively less in each blade in the rotational direction of the development roll 112) again so that the additional blades 124, 126, 128 do not remove any toner that has been allowed to remain on the development roll 112 by the first charge blade. Similarly, overhang of these additional blades 124, 126, 128 are all less than the overhang of the first charge blade 122 (or can be progressively less in each blade in the rotational direction of the development roll 112) again so that the additional blades 124, 126, 128 do not remove any toner that has been allowed to remain on the development roll 112 by the first charge blade.

While the exemplary design shown in the drawings has two and four charge blades, those ordinarily skilled in the art would understand that the charge blade could include three charge blades (or many more charge blades) depending on the toner properties, speed of the development roll, diameter of the roll, etc.

The structures presented herein provide improved metering and charging of a toner layer within a development cartridge. By providing multiple charge blades (nips) the toner layer has more frictional area to charge, which creates a charge that is sufficiently high, and sufficiently uniform, to enable good development to the photoreceptor with no background. By providing more frictional charging area, these devices can handle a toner design that may not charge as well as the toner originally designed for a given printer. The first charge blade 122 provides both a nip forming feature, and a metering function. As the force of each additional blade 124, 126, 128 is reduced, the amount of toner provided to the development zone is increased. By having the first charge blade exert the most pressure (force) against the development roll, this ensures that no toner is metered by the second and subsequent charge blades, but the second and subsequent charge blades provide frictional charging to increase the amount and uniformity of the charge within the toner on the development roll.

Stated in more generic terms, various print devices 10 (see FIG. 4, discussed below for some elements) include a media feeder 34 (one example of which is a sheet feeder); and a transfer device 18 (one example of which is a photoreceptor) adjacent the media feeder 34. The transfer device 18 receives print media 15 from the media feeder 34, and the transfer device 18 transfers marking material T (one example of which is toner) to the print media 15. A marking material feeder 112 (one example of which is a development roll) is adjacent the transfer device 18. The marking material feeder 112 supplies the marking material T to the transfer device 18. Further, a supply device 113 (one example of which is a supply roll) is adjacent the marking material feeder 112. The supply device 113 supplies the marking material T to the marking material feeder 112.

A charge blade assembly 114 contacts the marking material feeder 112, and a charge generator 120 is electrically connected to the charge blade assembly 114. The charge blade assembly 114 has multiple charge blades 122, 124, 126, 128 that applies a force against the development roll 112 to enable friction between the toner T and the development roll 112, which electrically charges the toner.

The marking material feeder 112 has an outer surface moving (e.g., rotating) in a first direction. The first charge blade 122 is positioned before the second charge blade 124 in the first direction such that the rotating outer surface of the marking material feeder 112 contacts the first charge blade 122 before contacting the second charge blade 124 (when moving in the first direction).

The first charge blade 122 and the additional charge blades 124, 126, 128 comprise contact areas touching the curved outer surface of the marking material feeder 112, thereby forming at least two nips (at least two different linear areas of contact between the charge blade assembly 114 and the marking material feeder 112). All of the contact areas simultaneously touch the curved outer surface of the marking material feeder 112.

The first charge blade 122 removes marking material T and produces a first amount of charge in the marking material T on the marking material feeder 112. The second and additional charge blades 124, 126, 128 do not remove any additional marking material (because they are exerting relatively less pressure against the development roll 112) but the additional charge blades 124, 126, 128 increase the amount of, and uniformity of, charge within the marking material T on the marking material feeder 112 (to a second amount of charge that is larger and more uniform than the first amount of charge). Thus, the higher force of the first charge blade 122 performs all the metering of marking material T positioned on the marking material feeder 112, and the smaller forces exerted by the additional charge blades 124, 126 128 does not affect the amount of marking material T metered on the marking material feeder 112 by the first charge blade 122, but simply make the charge more uniform and increase the charge.

Figure 4:
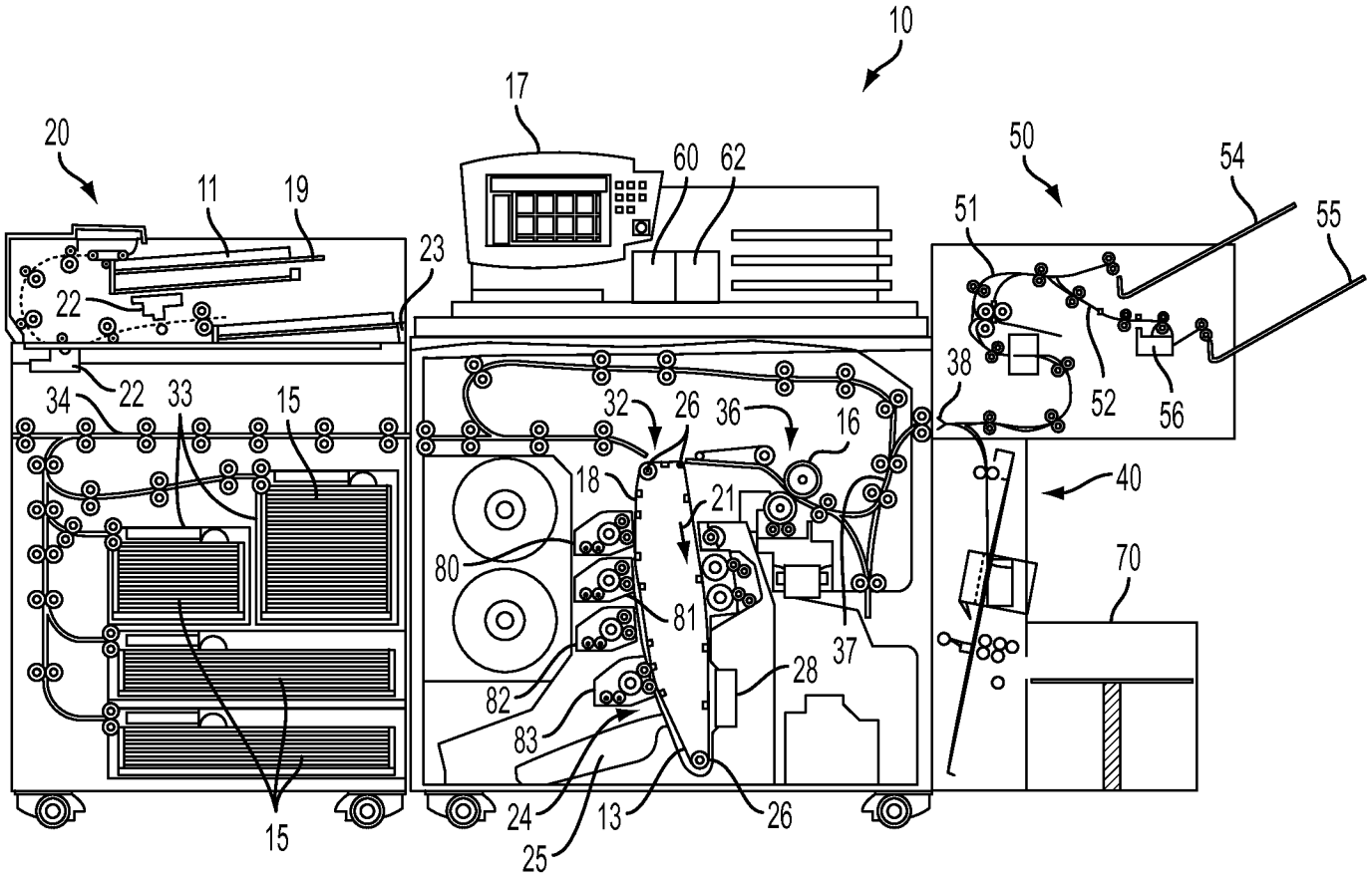
FIG. 4 is a cross-sectional schematic diagram illustrating devices herein.

Referring to the FIG. 4 printing machine 10 is shown that includes an automatic document feeder 20 (ADF) that can be used to scan (at a scanning station 22) original documents 11 fed from a tray 19 to a tray 23. The user may enter the desired printing and finishing instructions through the graphic user interface (GUI) or control panel 17, or use a job ticket, an electronic print job description from a remote source, etc. The control panel 17 can include one or more processors 60, power supplies, as well as storage devices 62 storing programs of instructions that are readable by the processors 60 for performing the various functions described herein. The storage devices 62 can comprise, for example, non-volatile tangible storage mediums including magnetic devices, optical devices, capacitor-based devices, etc.

An electronic or optical image or an image of an original document or set of documents to be reproduced may be projected or scanned onto a charged surface 13 or a photoreceptor belt 18 to form an electrostatic latent image. The belt photoreceptor 18 here is mounted on a set of rollers 26. At least one of the rollers is driven to move the photoreceptor in the direction indicated by arrow 21 past the various other known electrostatic processing stations including a charging station 28, imaging station 24 (for a raster scan laser system 25), developing stations 80-83, and transfer station 32. Note that devices herein can include a single development station 80, or can include multiple development stations 80-83, all of which include the charge blade assembly 114 discussed above.

Thus, the latent image is developed with developing material to form a toner image corresponding to the latent image. More specifically, a sheet 15 is fed from a selected paper tray supply 33 to a sheet transport 34 for travel to the transfer station 32. There, the toned image is electrostatically transferred to a final print media material 15, to which it may be permanently fixed by a fusing device 16. The sheet is stripped from the photoreceptor 18 and conveyed to a fusing station 36 having fusing device 16 where the toner image is fused to the sheet. A guide can be applied to the substrate 15 to lead it away from the fuser roll. After separating from the fuser roll, the substrate 15 is then transported by a sheet output transport 37 to output trays a multi-function finishing station 50.

Printed sheets 15 from the printer 10 can be accepted at an entry port 38 and directed to multiple paths and output trays 54, 55 for printed sheets, corresponding to different desired actions, such as stapling, hole-punching and C or Z-folding. The finisher 50 can also optionally include, for example, a modular booklet maker 40 although those ordinarily skilled in the art would understand that the finisher 50 could comprise any functional unit, and that the modular booklet maker 40 is merely shown as one example. The finished booklets are collected in a stacker 70. It is to be understood that various rollers and other devices, which contact and handle sheets within finisher module 50, are driven by various motors, solenoids and other electromechanical devices (not shown), under a control system, such as including the microprocessor 60 of the control panel 17 or elsewhere, in a manner generally familiar in the art.

Thus, the multi-functional finisher 50 has a top tray 54 and a main tray 55 and a folding and booklet making section 40 that adds stapled and unstapled booklet making, and single sheet C-fold and Z-fold capabilities. The top tray 54 is used as a purge destination, as well as, a destination for the simplest of jobs that require no finishing and no collated stacking. The main tray 55 can have, for example, a pair of pass-through sheet upside down staplers 56 and is used for most jobs that require stacking or stapling As would be understood by those ordinarily skilled in the art, the printing device 10 shown in FIG. 4 is only one example and the systems and methods herein are equally applicable to other types of printing devices that may include fewer components or more components. For example, while a limited number of printing engines and paper paths are illustrated in FIG. 4, those ordinarily skilled in the art would understand that many more paper paths and additional printing engines could be included within any printing device used with systems and methods herein.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the systems and methods described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intend portioned to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. A marking material delivery apparatus comprising:

a marking material feeder, said marking material feeder supplying marking material to a transfer device;

a supply device adjacent said marking material feeder, said supply device supplying said marking material to said marking material feeder;

a first charge blade contacting said marking material feeder;

a second charge blade contacting said marking material feeder; and a third charge blade contacting said marking material feeder, said first charge blade applying more pressure against said marking material feeder relative to said second charge blade, and said second charge blade being positioned between said first charge blade and said third charge blade.

2. The marking material delivery apparatus according to claim 1, said marking material feeder having a surface rotating in a first direction, and said surface of said marking material feeder contacting said first charge blade before contacting said second charge blade when rotating in said first direction.

3. The marking material delivery apparatus according to claim 1, said first charge blade controlling an amount of marking material positioned on said marking material feeder and said second charge blade not affecting said amount of marking material positioned on said marking material feeder.

4. The marking material delivery apparatus according to claim 1, said first charge blade producing a first amount of charge in said marking material on said marking material feeder, and said second charge blade increasing charge within said marking material on said marking material feeder to a second amount of charge that is larger than said first amount of charge.

5. The marking material delivery apparatus according to claim 1, said first charge blade and said second charge blade simultaneously touching a curved outer surface of said marking material feeder.

6. A printing apparatus comprising:

a media feeder;

a transfer device adjacent said media feeder, said transfer device receiving print media from said media feeder, and said transfer device transferring marking material to said print media;

a marking material feeder, said marking material feeder supplying marking material to a transfer device;

a supply device adjacent said marking material feeder, said supply device supplying said marking material to said marking material feeder;

a first charge blade contacting said marking material feeder;

a second charge blade contacting said marking material feeder; and a third charge blade contacting said marking material feeder, said first charge blade applying more pressure against said marking material feeder relative to said second charge blade, and said second charge blade being positioned between said first charge blade and said third charge blade.

7. The printing apparatus according to claim 6, said marking material feeder having a surface rotating in a first direction, and said surface of said marking material feeder contacting said first charge blade before contacting said second charge blade when rotating in said first direction.

8. The printing apparatus according to claim 6, said first charge blade controlling an amount of marking material positioned on said marking material feeder and said second charge blade not affecting said amount of marking material positioned on said marking material feeder.

9. The printing apparatus according to claim 6, said first charge blade producing a first amount of charge in said marking material on said marking material feeder, and said second charge blade increasing charge within said marking material on said marking material feeder to a second amount of charge that is larger than said first amount of charge.

10. The printing apparatus according to claim 6, said first charge blade and said second charge blade simultaneously touching a curved outer surface of said marking material feeder.

11. A printing apparatus comprising:

a sheet feeder;

a photoreceptor adjacent said sheet feeder, said photoreceptor receiving print media from said sheet feeder, and said photoreceptor transferring marking material to said print media;

a development roll, said development roll supplying marking material to a photoreceptor;

a supply roll adjacent said development roll, said supply roll supplying said marking material to said development roll;

a first charge blade contacting said development roll;

a second charge blade contacting said development roll; and a third charge blade contacting said development roll, said first charge blade applying more pressure against said development roll relative to said second charge blade, and said second charge blade being positioned between said first charge blade and said third charge blade.

12. The printing apparatus according to claim 11, said development roll having a surface rotating in a first direction, and said surface of said development roll contacting said first charge blade before contacting said second charge blade when rotating in said first direction.

13. The printing apparatus according to claim 11, said first charge blade controlling an amount of marking material positioned on said development roll and said second charge blade not affecting said amount of marking material positioned on said development roll.

14. The printing apparatus according to claim 11, said first charge blade producing a first amount of charge in said marking material on said development roll, and said second charge blade increasing charge within said marking material on said development roll to a second amount of charge that is larger than said first amount of charge.

15. The printing apparatus according to claim 11, said first charge blade and said second charge blade simultaneously touching a curved outer surface of said development roll.

* * * * *